United States Patent [19]

Knight et al.

[11] Patent Number: 4,957,152

[45] Date of Patent: Sep. 18, 1990

[54] CORD TENSIONING DEVICE

[75] Inventors: Peter E. Knight, Walsall; John E. Lyons, Burton-on-Trent, both of United Kingdom

[73] Assignee: Swish Products Limited, Staffordshire, England

[21] Appl. No.: 189,155

[22] Filed: May 2, 1988

[51] Int. Cl.[5] ..... A47H 5/00

[52] U.S. Cl. ..... 160/345; 160/178.2; 24/136 A; 188/65.1

[58] Field of Search ..... 160/345, 346, 347, 178.2, 160/84.1; 188/65.1, 65.3; 24/136 A, 115 L

[56] References Cited

U.S. PATENT DOCUMENTS

| | | | |
|---|---|---|---|
| 1,921,627 | 8/1933 | Lucchesi | 188/65.1 |
| 2,357,911 | 9/1944 | Schaefer | 160/173 |
| 3,253,645 | 5/1966 | Stall | 160/178.2 X |
| 3,337,903 | 8/1967 | Kenney | 160/345 X |
| 3,455,365 | 7/1969 | Stall | 160/178.2 X |
| 3,709,071 | 1/1973 | Moransais | 24/136 A X |
| 3,931,846 | 1/1976 | Zilver | 160/178.2 |
| 4,129,927 | 12/1978 | Anderson | 24/136 A |
| 4,651,795 | 3/1987 | Valle et al. | 160/178.2 |

*Primary Examiner*—David M. Purol

*Attorney, Agent, or Firm*—Wolf, Greenfield & Sacks

[57] ABSTRACT

Disclosed is a device for applying tension to the free ends of a curtain track draw cord that is looped about a pulley at one end of the track. The device consists of a first member containing two parallel channels to acept the free ends of the draw cord and second member, attached to a second pulley block at the opposite end of the curtain track, to which the first member is secured to trap the cords therebetween. The second member contains tubular passageways opposite and perpendicular to the channels in the first member in which are contained coil springs, ball bearings are located between the springs and the draw cords cause the cords to frictionally engage the walls of the channels and maintain tension in the cords lying within the curtain track.

8 Claims, 1 Drawing Sheet

1
2
3
4
5
6
10
11
12
13
14
15
16
17
18
19
21
22
23
24
25
26
30
31
32
40
41
42
43
44
45
46
47
48
49
50
51
52
53
2a
3a

CORD TENSIONING DEVICE

BACKGROUND OF THE INVENTION

The present invention relates to a cord tensioning device that has special application in tensioning curtain draw cords.

It is desirable that curtain draw cords be maintained in a tensioned condition, especially when spanning wide windows, in order to prevent snagging and tangling. To achieve this condition various tensioning devices have been proposed, for example a device remote from the curtain rail and attached to an adjacent wall which engages both runs of cords at the loop, the curtain being drawn across the window by pulling one of the tensioned cords at a point between the rail and the tensioning device.

We have now developed a simple device that can be secured at one end of a curtain rail, thereby allowing the cord loop to hang freely from the rail.

SUMMARY OF THE INVENTION

The invention comprises a device for applying tension to the free ends of the cord looped about a pulley, said cord carrying means to suspend articles therefrom for movement with the said cord comprising; a first member containing open channel means to receive each cord run, a second member to at least partially close each said channel and to retain said cords in their respective channels, and resilient pressure means, acting between said second member and the cords to urge each said cord into frictional contact with a wall of a respective channel means opposite said second member, whereby the runs of said cord between the said pulley and the device may be tensioned by the application of a tensioning force to one or both free ends of the cord on the side of the device remote from the said pulley.

The cord may be a curtain draw cord, positioned within a curtain rail, and the device may be secured to an element forming an end portion of the said rail.

The expression "pulley" includes a pulley wheel, a spindle or any other low friction means around which cord may be looped at one end of a curtain rail, for example.

The means acting between the second member and the cord may be a ball bearing urged towards the cord by a resilient member such as a spring acting between the second member and the ball bearing and positioned in a tubular channel formed in said second member.

BRIEF DESCRIPTION OF THE DRAWINGS

One embodiment of the invention will now be described with reference to the accompanying drawings in which.

DETAILED DESCRIPTION OF THE PREFERRED EMBODIMENTS

Figures 1, 2, 3:
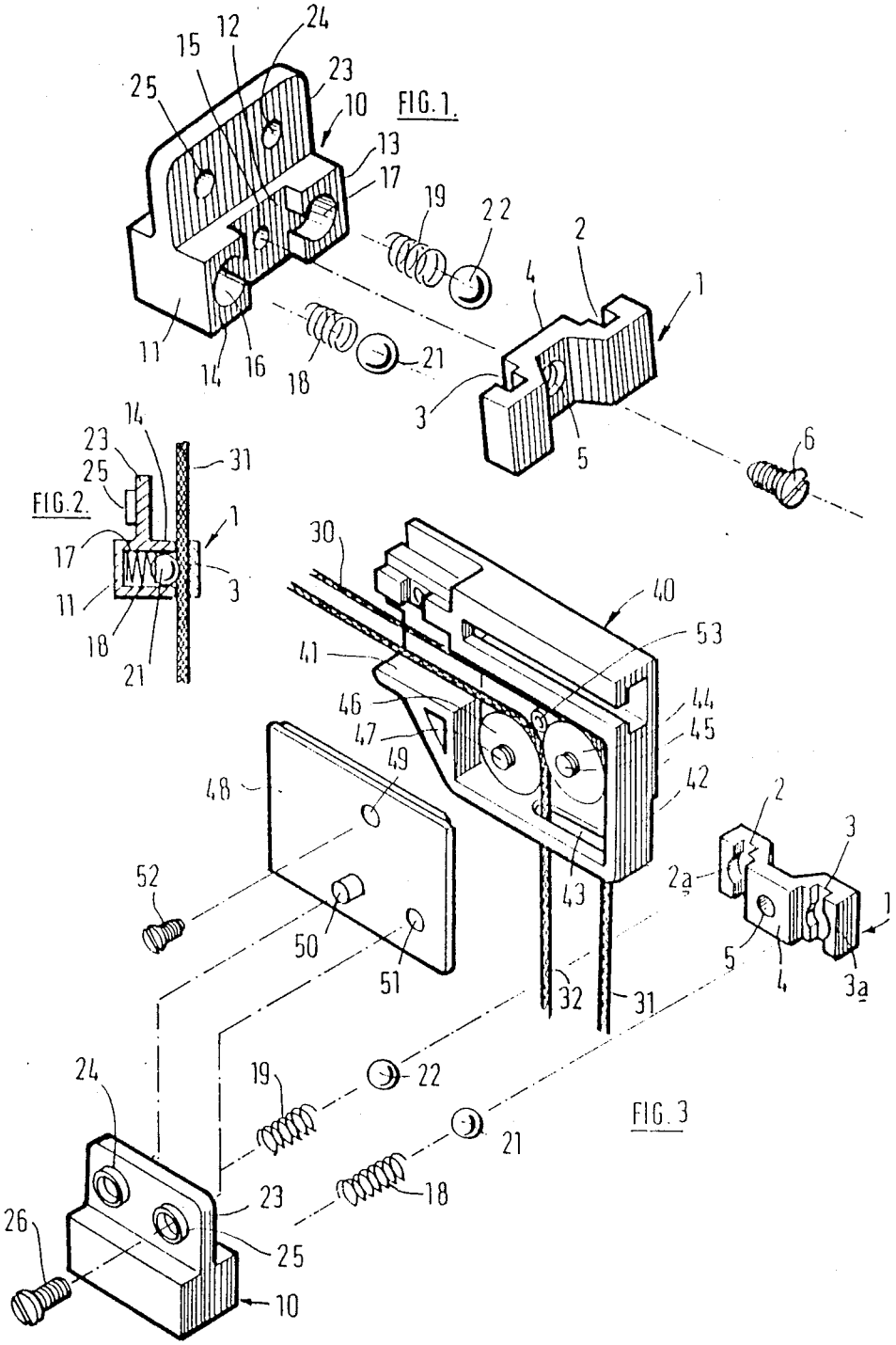
FIG. 1 is a diagrammatic exploded view of the device of the present invention.
FIG. 2 is a section through the device of FIG. 1 including a draw cord.
FIG. 3 is a diagrammatic exploded view of the device of FIG. 1 and associated portion of a curtain rail.

Referring to FIG. 1, a device of the present invention comprises a first member, 1, containing open channels 2 and 3 and a forward facing abutment element 4. A hole 5 is formed through the abutment element 4 through which a self-tapping screw 6 can be passed. A second member, generally indicated at 10, comprises a body 11 including a recessed portion 12 to receive abutment element 4 of member 1, and defining two faces 13 and 14, which act to close the upper and lower ends of channels 2 and 3 in member 1. Tubular recesses 16 and 17 are formed in faces 13 and 14 at right angles thereto to receive coil springs 18 and 19 respectively. Ball bearings 21 and 22 are located at the end of springs 18 and 19, and engage within recesses 2*a* and 3*a* formed in channels 2 and 3 of member 1 (see FIG. 3*a*). A hole 15 is formed in recessed portion 1 of member 2 to receive self-tapping screw 6 whereby member 1 is secured to member 2 and retains springs 18, 19 and ball bearings 21 and 22 between said members. A plate 23 extends upwardly of body element 11, and contains holes 24 and 25 to permit attachment to a curtain rail.

FIG. 2 illustrates a section of the device of FIG. 1 including a cord passing through channel 3. As can be seen the ball bearing 21 is urged against cord 31 by the action of spring 18 causing the cord to make frictional contact with the back of channel 3.

In FIG. 3 there is illustrated an end portion of a curtain rail, generally indicated at 40, which includes a hollow box portion 42 containing pulleys 44 and 46 carried on spindles 45 and 47 respectively. A draw cord, generally indicated at 30, is contained within channel 41 of rail 40, and has two runs 31 and 32 passing over pulleys 44 and 46 respectively, portions 31 and 32 passing through slot 43 in the bottom of portion 42 of rail 40, and hanging down to form a loop (not shown) adjacent a wall.

The front end portion of the rail is enclosed by a plate 48, held in position by a screw 52 passing through hole 49 into a threaded member 53 secured to the back wall of hollow member 42. A dowl 50 projects outwardly of plate 48 and is a force fit through hole 24 formed in plate 23 of member 10; a threaded hole 51 spaced from dowl 30 receives a set screw 26 which passes through hole 25 of plate 23, thereby securing the device of the present invention to the front plate 48 of rail 40. With member 10 secured to the front face the device is then assembled with cords 31 and 32 located in channels 3 and 2 of member 1. In the assembled condition cords 31 and 32 are urged into frictional contact with rear walls of channels 3 and 2, by ball bearings 21 and 20 respectively, acting under the influence of springs 18 and 19.

In use, when desired to move the curtains across a window, either cord 31 or 32 has tension applied. Because the cords are close to the wall, this tension is usually not applied vertically but the cords are pulled outwardly slightly from the wall with the result that the springs 18 and 19 are compressed allowing the cords to slide between the bearing and the rear walls of the channels, at the same time the lengths of the cord within the curtain rail are also tensioned. When the curtains have been moved to the required position, and tension in the cords relaxed, ball bearings 21 and 22 acting under the influence of springs 18 and 19 cause the cords 31 and 32 to again make frictional contact with the rear walls of channels 3 and 2, thereby preventing slippage of the cord under the weight of the lengths of the cords within the rail so that the said lengths remain under tension.

The ball bearings 20 and 21 may, of course, be replaced by other means such as T-shaped stem members having stems which are located within the coil springs 18 and 19. Preferably such T-shaped members have curved "mushroom" heads. Similarly, the springs may be replaced by suitably resilient material such as rubber.

We claim:

1. A device for maintaining tension in two runs of a cord, said runs of cord having at one end of the run a first means about which a cord is looped to provide the said runs of cord and at the other end second means over which the said runs of cord pass to provide end portions extending downwardly of said runs, said device comprising;

a first member containing two parallel open channel means to receive a respective downwardly extending end portion of each of said runs of cord, a second member at least partially closing each said channel to retain said end portions in their respective channels, and resilient pressure means acting between said second member and said end portions to urge each said end portion into frictional contact with a wall of its respective channel means opposite said second member, whereby the runs of the cord may be tensioned by the application of a tensioning force to one or both of said downwardly extending end portions, and the said runs of cord remaining in a tensioned condition when the said tensioning force is removed.

2. A device according to claim 1 where the cord is a draw cord for a curtain.

3. A device according to claim 1 wherein the resilient means 20 acting between the second member and the end portions of the cord comprises a ball bearing ballbearing and a resilient member positioned between the ballbearing and the said second member.

4. A device according to claim 3 wherein the resilient member is a coil spring.

5. A device according to claim 2 wherein the said second member is secured to an element forming an end portion of a curtain rail.

6. A curtain suspension device comprising;

a rail member containing a longitudinal channel extending between the ends thereof, a curtain draw cord located in said channel and comprising two runs for movement in opposite directions along said channel, each run having an end portion extending downwardly of one end of said rail, first means positioned at said one end of the rail to support each said run of the draw cord and from which said end portions extend downwardly, second means positioned at said one end of said rail and comprising; a first member containing open channel means to receive each said downwardly extending portion of each said run, a second member at least partially closing each said channel to retain the downwardly extending end portions in their respective channels, and resilient pressure means acting between the second member and the downwardly extending end portions to urge each end portion into frictional contact with a wall of a respective channel means opposite said second member, whereby the runs of said cord located in said channel of the rail member may be tensioned by the application of a tensioning force to one or both of the downwardly and extending end portions of said cord on the side of the device remote from the rail.

7. A device according to claim 6 wherein the resilient means acting between the second member and the cord comprises a ball bearing ballbearing and a resilient member positioned between the ball bearing and the said second member.

8. A device according to claim 7 wherein the resilient member is a coil spring.

* * * * *